US005850927A

United States Patent [19]

Pan

[11] Patent Number: 5,850,927

[45] Date of Patent: Dec. 22, 1998

[54] FREE-STANDING COLLAPSIBLE THREE-DIMENSIONAL WIRE FRAMEWORK AND LIGHT SUPPORTING DISPLAY

[76] Inventor: Wen-Hua Pan, B1, 11F, 126, Sec. 4, Nanking East Road, Taipei, Taiwan

[21] Appl. No.: 106,693

[22] Filed: Jun. 29, 1998

Related U.S. Application Data

[60] Provisional application No. 60/075,189 Feb. 19, 1998.

[51] Int. Cl.[6] ..... A47F 5/00

[52] U.S. Cl. ..... 211/181.1; 211/26; 211/195; 248/175; D11/127; 362/252

[58] Field of Search ..... 211/181.1, 195, 211/26; 248/166, 175; D11/127, 158, 159; D26/98; D6/417, 453, 462; 362/252

[56] References Cited

U.S. PATENT DOCUMENTS

| | | | |
|---|---|---|---|
| D. 392,208 | 3/1998 | Chong | D11/127 |
| 1,652,936 | 12/1927 | Heinz | 211/181.1 X |
| 4,978,013 | 12/1990 | Hogg | 211/181.1 X |
| 5,103,799 | 4/1992 | Atanasio | 211/181.1 X |
| 5,213,221 | 5/1993 | Raye | 211/195 |
| 5,379,202 | 1/1995 | Daun | 362/252 |
| 5,451,436 | 9/1995 | Shelleman | D11/158 X |
| 5,507,399 | 4/1996 | Hermanson | 211/181.1 |
| 5,683,172 | 11/1997 | Huag | 362/252 |

*Primary Examiner*—Robert W. Gibson, Jr.
*Attorney, Agent, or Firm*—Donald A. Kettlestrings

[57] ABSTRACT

A free-standing, collapsible, three-dimensional wire framework and light supporting display for use as a light sculpture includes a plurality of wire frame assemblies hingedly connected to each other for enabling the framework and display to be quickly and easily unfolded and erected for use. Each of the wire frame assemblies defines a portion of a figure, such as a deer, and the wire frame assemblies can be quickly and easily folded together into a compact configuration for transport and/or storage.

14 Claims, 5 Drawing Sheets

FREE-STANDING COLLAPSIBLE THREE-DIMENSIONAL WIRE FRAMEWORK AND LIGHT SUPPORTING DISPLAY

This application claims benefit of U.S.C. Provisional Application No. 60,075,189, filed Feb. 19, 1998.

BACKGROUND OF THE INVENTION

This invention relates to a light sculpture framework and more particularly to a free-standing, collapsible, three-dimensional wire framework and light supporting display for use as a Christmas light sculpture.

Light sculptures and light sculpture frameworks for supporting lights are known and widely used by consumers. Because of the large size of known sculptures and sculpture frameworks, they are expensive to store and transport. Even if the sculpture or sculpture framework can be knocked down or disassembled to reduce the size of the sculpture, it is necessary to use tools to disassemble and to reassemble such sculptures. One example of such a known sculpture is described in U.S. Pat. No. 5,451,436.

Two-dimensional, collapsible, wire frames for creating light sculptures are also known. See U.S. Pat. No. 5,507,399. Such two-dimensional structures, however, do not provide the more realistic and lifelike displays that are provided by three-dimensional displays.

This invention provides for a free-standing, three-dimensional, collapsible or foldable light sculpture or light sculpture framework which does not require the use of tools to assemble or disassemble the light sculpture and which can be quickly and easily collapsed or folded into a compact shape for storage or transportation. The light sculpture of this invention can also be quickly and easily unfolded for display.

The three-dimensional light sculpture or light sculpture framework of this invention uses wire shaped into the forms of various figures, such as animals, human shapes, scenes, buildings, trees or characters, etc. When the framework is unfolded for display, conventional light sets can be quickly and easily clipped to the wire of the framework to provide a lighted display of the figures.

The sculpture or framework of this invention uses the wire of the framework to form pins and cylindrical receptacles. The pins rotatably fit into the cylindrical receptacles to act as hinges for enabling portions of the sculpture or framework to be rotated into folded positions and rotated into erected positions for display of the sculpture or framework. In the embodiment illustrated, the head and neck portion of a deer sculpture can be rotated to a folded position within the body portion of the sculpture, and the legs can be folded into side-by-side relationship with each other and adjacent to the body portion of the sculpture to provide for a compact, folded configuration which is easier and less expensive to transport and store.

When used as a display, the sculpture or framework can be unfolded with the head and neck portions and the leg portions positioned with respect to body portions to provide a stable free-standing sculpture or framework.

It is, therefore, an object of the present invention to provide a free-standing, three-dimensional, collapsible wire framework and light supporting display for use as a light sculpture.

Another object is to provide such a framework and display which can be quickly and easily collapsible or foldable without the use of tools.

A further object of the invention is the provision of such a framework and display which can be collapsed or folded into a compact shape for storage or transportation.

Still another object is to provide such a framework and display wherein the wire of the framework is shaped into the form of a figure, such as an animal or character.

Yet another object of the invention is the provision of such a framework and display which can be quickly and easily unfolded or erected for use.

A still further object is to provide such a framework and display to which can be quickly and easily attached conventional light sets to provide a lighted display of a figure, such as an animal or character.

Another object is to provide such a framework and display wherein wire portions of the wire framework are formed into hinges for movably connecting together a plurality of wire frame assemblies of the framework.

Still another object is to provide such a framework and display which includes movable locking elements for locking the wire frame assemblies into position when the framework and display is unfolded and erected for use.

A further object of the invention is the provision of such a framework and display wherein at least one of the wire frame assemblies of the framework can be folded into position to be stored within other frame assemblies of the framework to result in a compact, folded configuration.

Another object is to provide such a framework and display wherein all portions of the framework, including locking elements, are permanently connected together so that no parts of the framework, including locking elements, can be separated from the framework or lost.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides a free-standing, three-dimensional, collapsible wire framework and light supporting display comprising: a first wire frame assembly defining a first predetermined portion of a figure; a second wire frame assembly defining a second predetermined portion of a figure, the second assembly hingedly connected to the first frame assembly for movement between a first open position and a second closed position in relationship with the first frame assembly; a third wire frame assembly defining a third predetermined portion of the figure, the third frame assembly hingedly connected to the first frame assembly for movement between a first erected position and a second folded position; the first and third frame assemblies sized and configured for enabling the first frame assembly to receive the third frame assembly at least partially within the first frame assembly when the third frame assembly is hingedly moved from the first erected position to the second folded position; the first, second and third frame assemblies further sized and configured for enabling the second frame assembly to receive the third frame assembly at least partially within the second frame assembly when the second frame assembly is hingedly moved from the first open position to the second closed position while the third assembly is in the second folded position and is received at least partially within the first frame assembly; and at least one fourth wire frame support assembly defining a fourth predetermined portion of the figure, the fourth frame assembly hingedly connected to the first frame assembly for movement between a first erected position and a second folded position.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
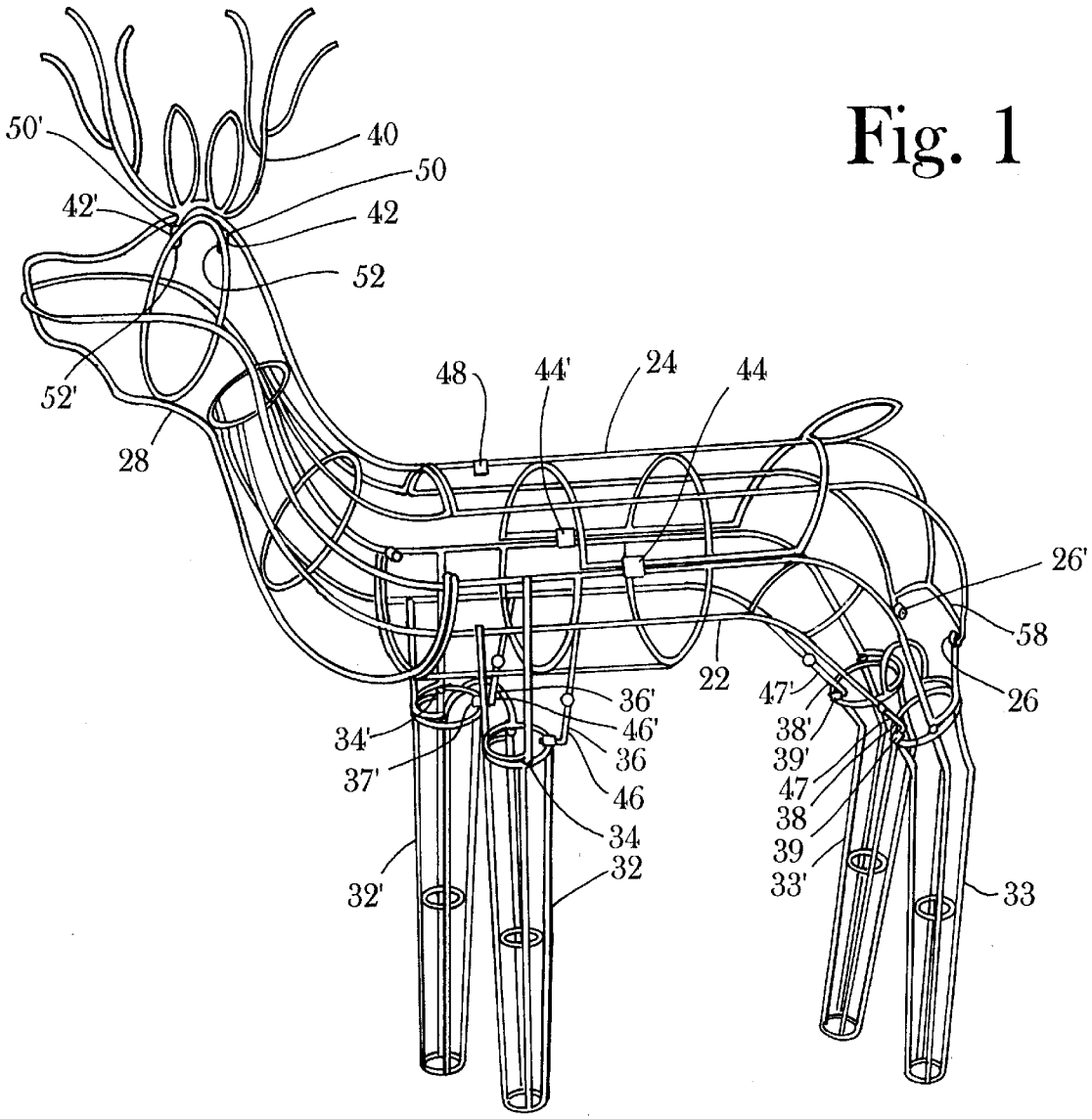
FIG. 1 is a perspective view showing the deer display in its free-standing, erected configuration.

With reference now to the drawings, wherein like reference characters designate like or corresponding parts throughout the several views, there is shown a free-standing, collapsible, three-dimensional wire framework and light supporting display 20 in accordance with the invention which comprises a first three-dimensional wire frame assembly 22 defining a first predetermined portion of a figure, such as a deer. Framework 20 further comprises a second three-dimensional wire frame assembly 24 defining a second predetermined portion of the figure, second frame assembly 24 being hingedly connected to first frame assembly 22 by hinges 26, 26' for movement of assembly 24 between a first open position (see FIG. 2) and a second closed position (see FIG. 1) in relationship with first frame assembly 22.

Figure 2:
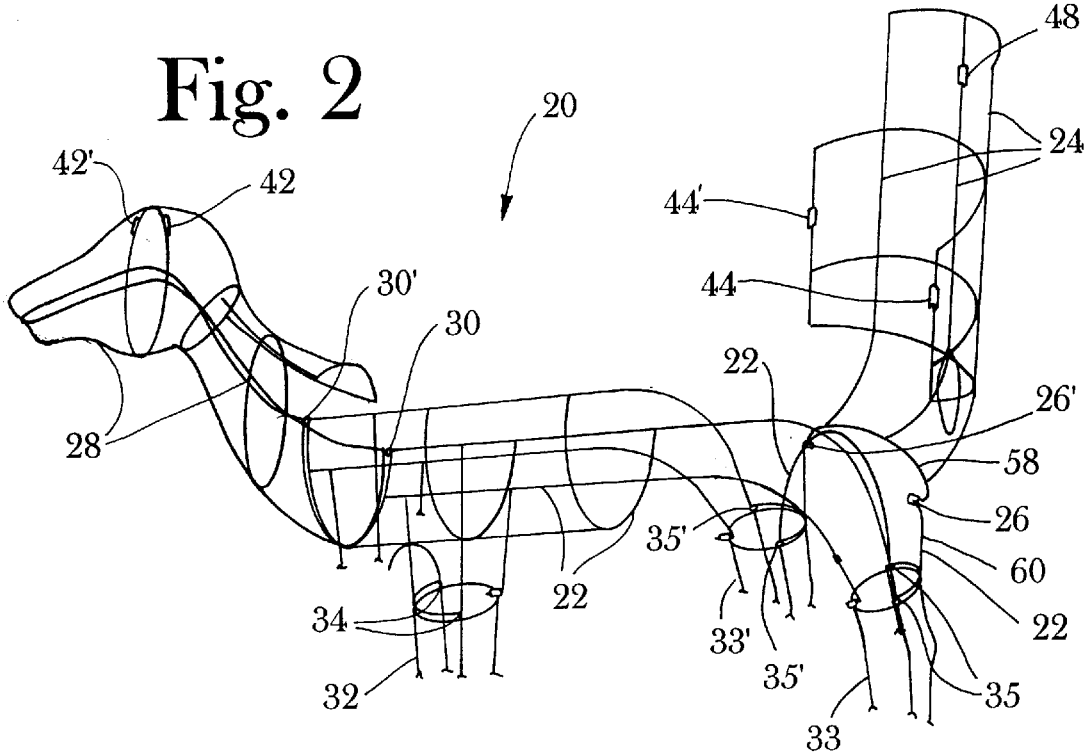
FIG. 2 is a fragmentary perspective view showing the deer display with the antlers removed and with an upper body portion of the deer display rotated to an open position.
Figure 3:
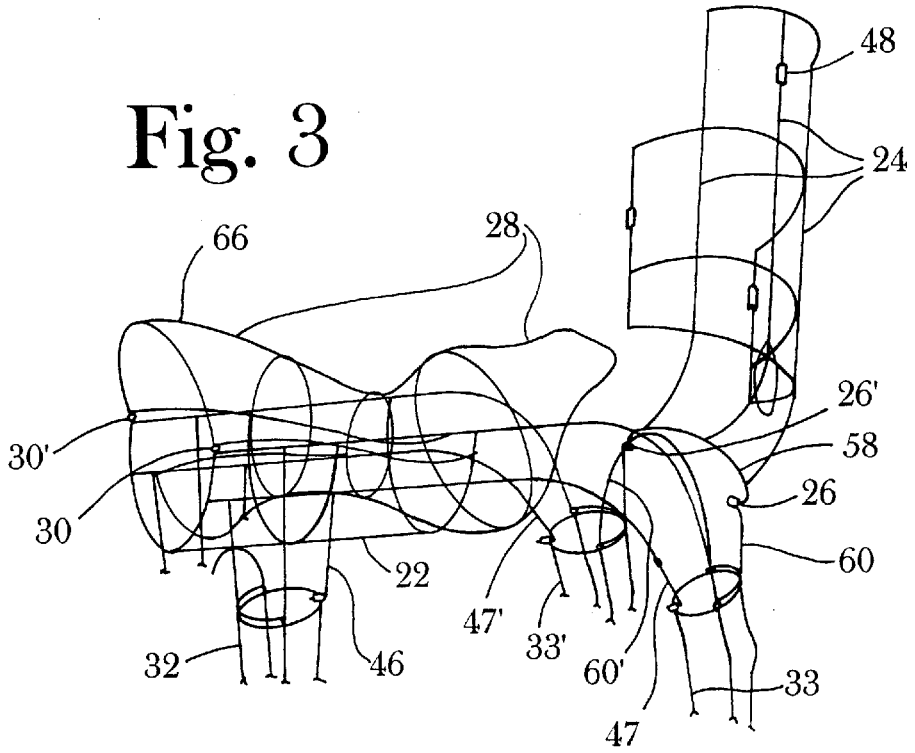
FIG. 3 is a fragmentary perspective view showing the deer display with the antlers removed and with a head and neck portion of the deer display folded into a lower body portion of the display.

Framework and display 20 also comprises a third three-dimensional wire frame assembly 28 defining a third predetermined portion or portions of the figure, and third wire frame assembly 28 is hingedly connected to first frame assembly 22 by hinges 30, 30' for movement of assembly 28 between a first erected position (see FIG. 2) and a second folded position (see FIG. 3).

Frame assemblies 22, 28 are sized and configured for enabling frame assembly 22 to receive frame assembly 28 at least partially within frame assembly 22 when frame assembly 28 is hingedly moved from the first erected position shown in FIG. 2 to the second folded position shown in FIG. 3.

Figure 4:
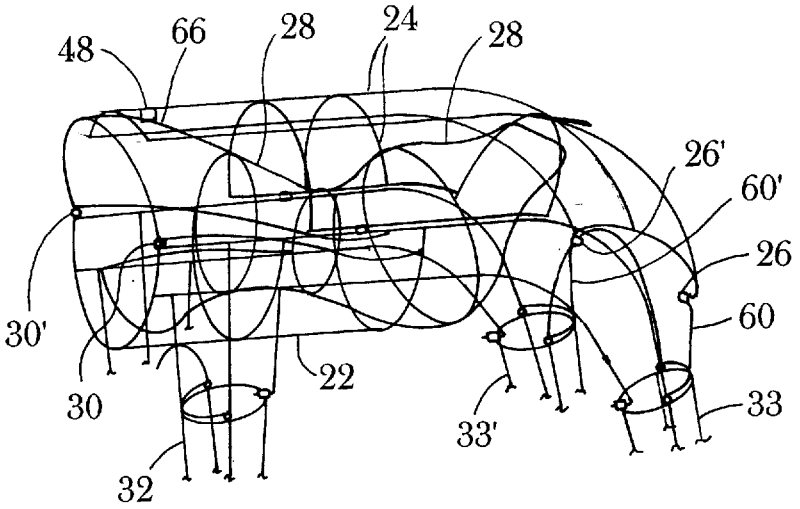
FIG. 4 is a fragmentary perspective view showing the deer display with the antlers removed, with the head and neck portion folded into the lower body portion, and with the upper body portion in its closed position so that the head and neck portion is positioned between the upper and lower body portions of the deer display.

Frame assemblies 22, 24 and 28 are further sized and configured for enabling frame assembly 24 to receive frame assembly 28 at least partially within frame assembly 24 when frame assembly 24 is hingedly moved from the first open position shown in FIG. 3 to the second closed position shown in FIG. 4 while frame assembly 28 is in the second folded position and is received at least partially within frame assembly 22. See FIG. 4.

Figure 5:
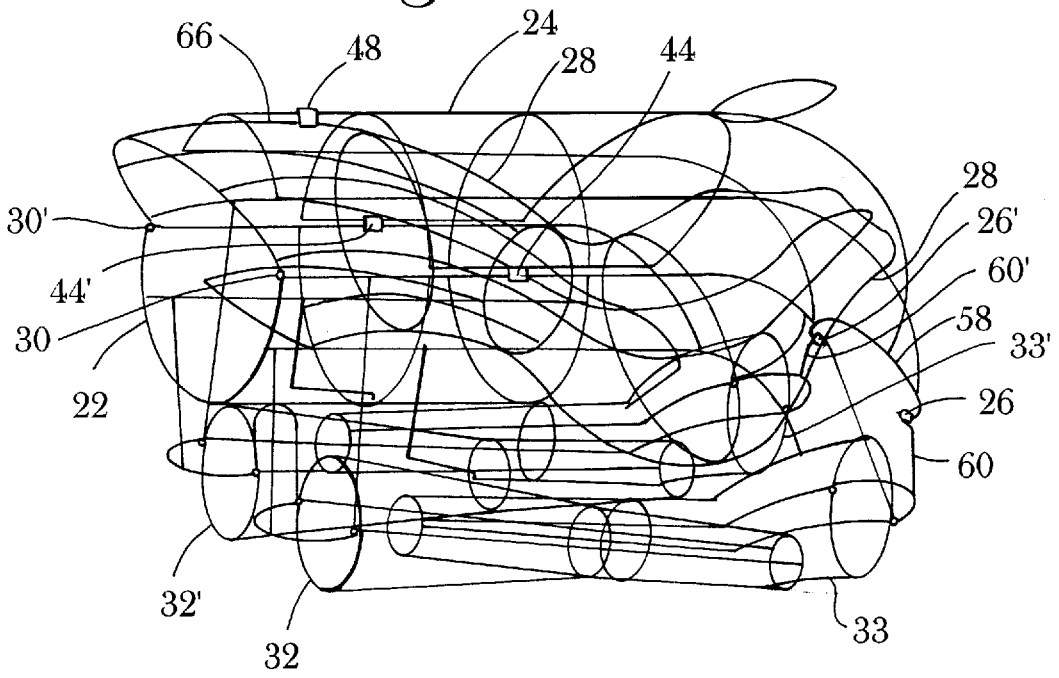
FIG. 5 is a perspective view showing the deer display positioned as shown in FIG. 4 and with the leg portions of the display in folded positions.
Figure 6:
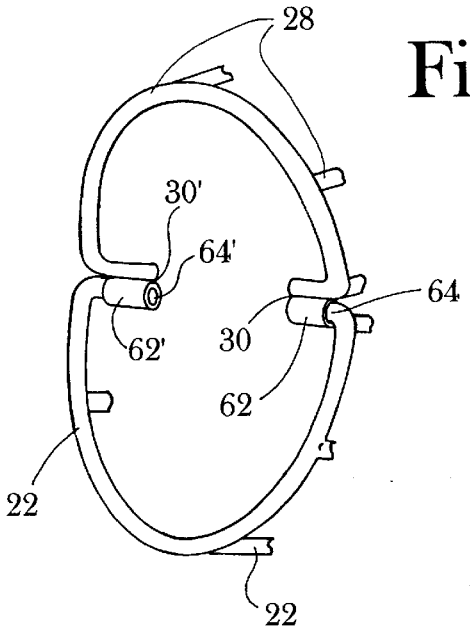
FIG. 6 is an enlarged detailed fragmentary perspective view showing the hinged connection between the head and neck portion of the deer display and the lower body portion of the display.
Figure 7:
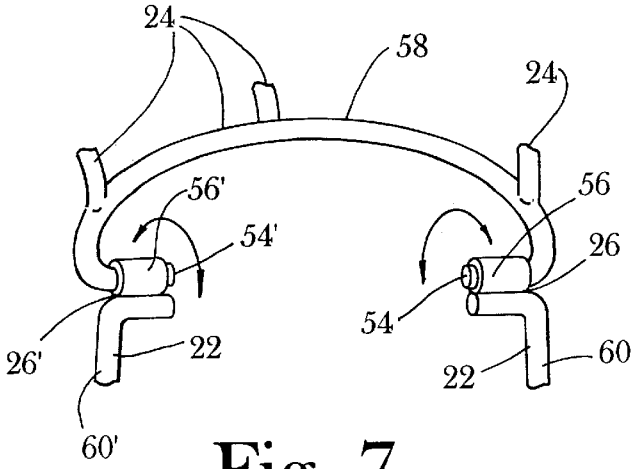
FIG. 7 is an enlarged detailed fragmentary perspective view showing the hinged connection between the lower and upper body portions of the deer display.
Figure 8:
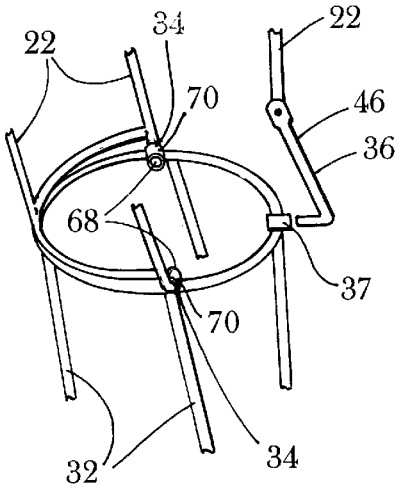
FIG. 8 is an enlarged detailed fragmentary perspective view showing the hinged connection between a front leg and the lower body portion of the display and showing the leg in an extended or unfolded position.
Figure 9:
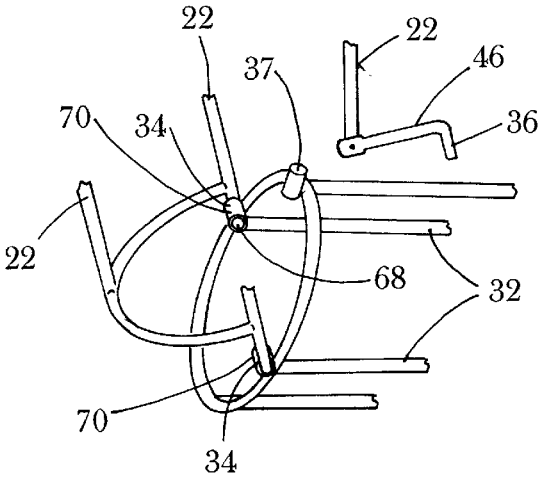
FIG. 9 is an enlarged detailed fragmentary perspective view showing the hinged connection illustrated in FIG. 8 but with the front leg in a folded position.
Figure 10:
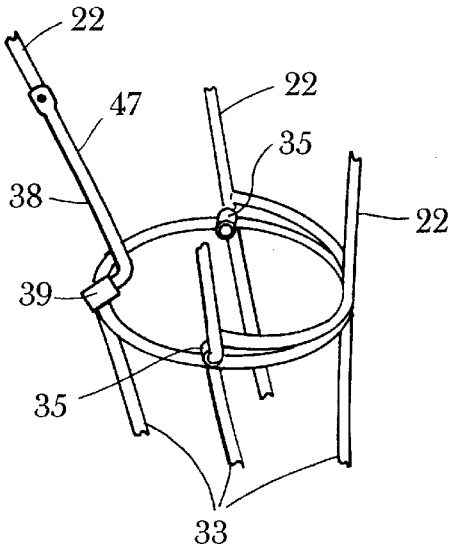
FIG. 10 is an enlarged detailed fragmentary perspective view showing the hinged connection between a rear leg and the lower body portion of the display and showing the leg in an extended or unfolded position.
Figure 11:
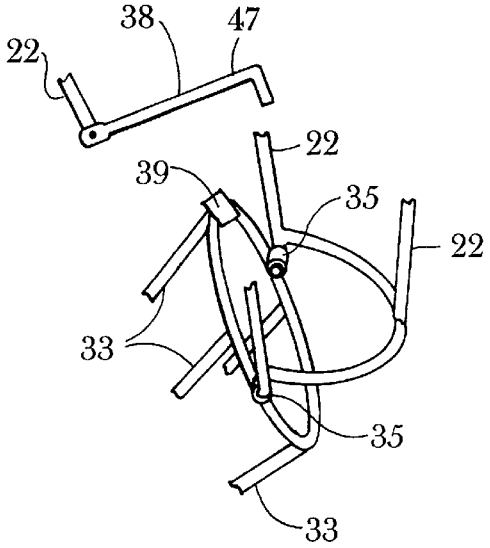
FIG. 11 is an enlarged detailed fragmentary perspective view showing the hinged connection illustrated in FIG. 10 but with the rear leg in a folded position.

In accordance with the invention, framework and display 20 further includes at least one fourth three-dimensional wire frame support assembly 32 which defines a fourth predetermined portion of the figure, and frame assembly 32 is hingedly connected to frame assembly 22 by hinges 34, for movement of assembly 32 between a first erected position (see FIG. 1) and a second folded position (see FIG. 5).

In the specific embodiment illustrated wherein the figure is a deer, frame and display 20 includes a plurality of fourth three-dimensional wire frame assemblies 32, 32', 33 and 33'. Each of wire frame assemblies 32, 32', 33 and 33' is similarly hingedly connected to frame assembly 22, by hinges 34, 34', 35 and 35', respectively, and frame assemblies 32, 32', 33 and 33' are located in compact side-by-side relationship with respect to each other in their folded positions, as shown in FIG. 5.

Framework and display 20 further includes means 36, 36', 38 and 38' in operative relationship with frame assemblies 22 and 32, 32', 33, 33', respectively, for releasably locking frame assemblies 32, 32', 33 and 33' in erected positions for enabling frame assemblies 32, 32', 33 and 33' to support framework and display 20 in a stable, free-standing configuration. See FIG. 1.

In the specific embodiment of framework and display 20 described and illustrated, the first predetermined portion defined by first wire frame assembly 22 is a lower body portion of a deer. The second predetermined portion defined by second wire frame assembly 24 is an upper body portion of the deer. The third predetermined portion defined by third wire frame assembly 28 includes the head and neck portions of the deer, and the fourth predetermined portions defined by fourth wire frame assemblies 32, 32', 33 and 33' are leg portions of the deer. A fifth three-dimensional wire frame assembly 40 is preferably provided which is formed into a shape representative of deer antlers, and means 42, 42' are provided in operative relationship with wire frame assembly 28 and with wire frame assembly 40 for removably attaching wire frame assembly 40 to wire frame assembly 28 when framework 20 is in an erected position for display. See FIG. 1.

Although a deer figure is specifically described and illustrated, it should be understood that this preferred embodiment and example is illustrative of the invention and is not to be construed as limiting the scope of this invention only to deer figures. Three-dimensional figures other than deer may be used within the scope of this invention. This invention also may provide for framework 20 to depict a character, scene or symbol or any other three-dimensional form or figure desired to be displayed.

Framework and display 20 further preferably includes means, such as clamps or clasps, 44, 44', connected to frame assembly 24 and in operative relationship with frame assemblies 22, 24 for holding frame assemblies 22, 24 together when frame assembly 24 is in the closed position shown in FIG. 1. Clamps or clasps 44, 44' grasp wire of assembly 22 to hold assemblies 22, 24 together when assembly 24 is in the closed position shown in FIG. 1.

Locking means 36, 36', 38 and 38' include openings 37, 37', 39 and 39', respectively, defined by each of fourth frame assemblies 32, 32', 33 and 33', respectively, and hook-shaped or L-shaped retaining members 46, 46', 47 and 47', respectively, hingedly connected to first frame assembly 22. See FIGS. 8–11. Each of retaining members 46, 46', 47 and 47' is removably positionable, respectively, within each of openings 37, 37', 39 and 39' for locking frame assemblies 32, 32', 33 and 33' in erected positions for supporting framework 20 in a stable, free-standing configuration, as shown in FIG. 1. Retaining members 46, 46', 47 and 47' are hingedly removable from within openings 37, 37', 39 and 39', respectively, for enabling frame assemblies 32, 32', 33 and 33' to be hingedly moved to compact, folded positions, as shown in FIG. 5.

Each of L-shaped retaining or locking members 46, 46', 47 and 47' is hingedly connected to frame assembly 22 so that the L-shaped retaining or locking members cannot be separated from framework 20 or lost. See FIGS. 8–11 for detailed views of openings 37, 37', 39 and 39'.

Framework and display 20 also preferably includes means 48, such as a clamp or clasp, connected to frame assembly 24 and in operative relationship with frame assemblies 24 and 28 for holding frame assemblies 24, 28 together when frame assembly 28 is at least partially positioned within frame assembly 24 and when frame assembly 24 is hingedly moved from its first open position (shown in FIG. 3) to its second closed position (shown in FIG. 4) while third frame assembly 28 is in a second folded position at least partially within first frame assembly 22, as shown in FIG. 4. Clamp 48 grasps wire of assembly 28 to hold assemblies 24, 28 together when assembly 28 is positioned within assemblies 22 and 24, as shown in FIG. 4.

Figure 12:
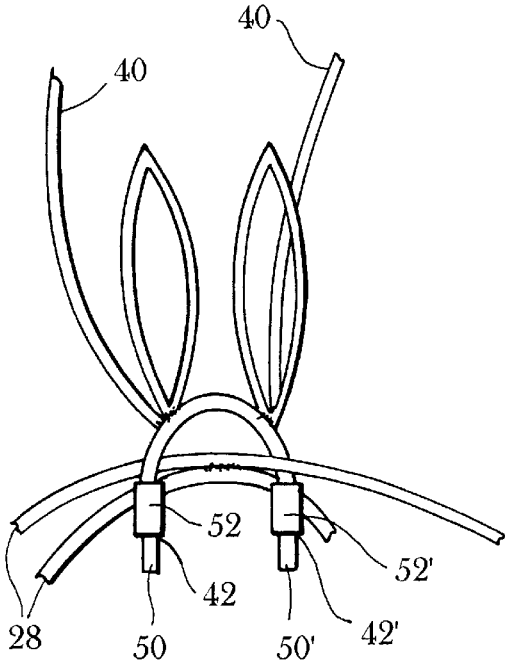
FIG. 12 is an enlarged detailed fragmentary perspective view showing the antlers and the cylindrical receptacles formed by the wire framework for receiving and holding the antlers.

In operation and use, framework 20 is collapsed or folded from its erected configuration shown in FIG. 1 into the compact folded configuration shown in FIG. 5 for storage or transport by first removing wire frame assembly 40, formed into a shape representative of deer antlers, from wire frame assembly 28, which is representative of the head and neck portions of the deer. Antlers 40 are removed from the head portion of frame assembly 28 by removing wire post portions 50, 50', formed by the wire of frame assembly 40, from cylindrical receptacles 52, 52', respectively, formed by the wire of the head portion of wire frame assembly 28. See FIG. 12.

Wire frame assembly 24, formed into the shape of the upper body portion of the deer, is then opened by rotating frame assembly 24 upwardly and backwardly about hinges 26, 26'. Hinges 26, 26' are formed by wire pin portions 54, 54' of wire frame assembly 24 which are rotatably positioned within cylindrical receptacles 56, 56', which are part of wire frame assembly 22. Movement of wire frame assembly 24 to the open position shown in FIG. 2 is limited by a wire portion 58 of assembly 24 contacting wire portions 60, 60' of frame assembly 22, which are portions of upper rear legs of the deer.

The head and neck portion of framework 20, as defined by wire frame assembly 28, is then rotated about hinges 30, 30' and rearwardly into a position within the open interior of wire frame assembly 22. See FIG. 3. Hinges 30, 30' are formed by cylindrical receptacles 62, 62', respectively, formed as portions of wire frame assembly 28. Hinges 30, 30' also include wire pin portions 64, 64' which are inserted into receptacles 62, 62', respectively, and which are formed as parts of wire frame assembly 22. Movement of frame assembly 28 causes cylindrical receptacles 62, 62' to rotate about pin portions 64, 64', respectively.

Wire frame assembly 24 is then rotated back to its original position atop wire frame assembly 22 so that wire frame assembly 28 is positioned within frame assemblies 22 and 24, as shown in FIG. 4. Clamp or clasp 48 removably snaps over a wire portion 66 of frame assembly 28 to prevent separation of frame assemblies 22, 24 and 28 from each other when framework 20 is in the folded position described and shown in FIG. 4.

Wire frame assemblies 32, 32', 33 and 33', representative of the leg portions of the deer, are then folded by first removing hooked or L-shaped retaining members 46, 46', 47, and 47' from within openings 37, 37', 39 and 39', respectively. Frame assemblies 32, 32', 33 and 33' are hingedly rotated to compact, folded positions shown in FIG. 5 about hinges 34, 34', 35 and 35', respectively. Each of hinges 34, 34', 35 and 35' is similarly constructed, and each wire frame assembly 32, 32', 33 and 33' is hingedly mounted to frame assembly 22 by two hinges. See FIGS. 8–11.

For example, leg portion defined by wire frame assembly 32 is hingedly connected to frame assembly 22 by two hinges 34. Each of hinges 34, for example, is formed by pin portions 68 which are part of frame assembly 22. Hinges 34 also each include cylindrical receptacles 70 which are formed as part of frame assembly 32. Frame assembly 32 is rotated by rotating cylindrical receptacles 70 about pin portions 68. Similar hinge configurations are provided for movement of each of wire frame assemblies 32, 32', 33 and 33', as shown in FIGS. 8–11.

The configurations and dimensions of frame assembly 22 and of frame assemblies 32, 32', 33 and 33' are such that when frame assemblies 32 and 32' are rotated rearwardly and frame assemblies 33 and 33' are rotated forwardly, all of frame assemblies 32, 32', 33 and 33' are positioned in side-by-side relationship with respect to each other and immediately adjacent to frame assembly 22. See FIG. 5. This creates a compact and conveniently transportable and storable folded configuration for framework 20.

When it is desired to erect or unfold framework 20, the process is reversed from that described with respect to folding of framework 20. Framework 20 in its erected or unfolded configuration, as shown in FIG. 1, provides a stable and rigid free-standing light supporting display for use as a light sculpture. Conventional lights, such as Christmas lights, can be quickly and easily attached to framework 20 in a conventional manner to provide a pleasing and interesting light display or sculpture.

This invention provides a free-standing, collapsible, three-dimensional wire framework and light supporting display for creating a light sculpture that does not require use of tools to assemble or disassemble the sculpture. The framework can be quickly and easily collapsed or folded into a compact shape for storage or transport, and the framework can be quickly and easily unfolded and erected for use and display. All portions of the framework, including locking elements, are permanently connected together so that no parts of the framework, including locking elements, can be separated from the framework or lost.

The invention in its broader aspects is not limited to the specific details shown and described, and departures may be made from such details without departing from the principles of the invention and without sacrificing its chief advantages.

What is claimed is:

1. A collapsible, three-dimensional wire framework and light supporting display comprising:

a first wire frame assembly defining a first predetermined portion of a figure;

a second wire frame assembly defining a second predetermined portion of said figure, said second frame assembly hingedly connected to said first frame assembly for movement between a first open position and a second closed position in relationship with said first frame assembly;

a third wire frame assembly defining a third predetermined portion of said figure, said third frame assembly hingedly connected to said first frame assembly for movement between a first erected position and a second folded position;

said first and third frame assemblies sized and configured for enabling said first frame assembly to receive said third frame assembly at least partially within said first frame assembly when said third frame assembly is hingedly moved from said first erected position to said second folded position;

said first, second and third frame assemblies further sized and configured for enabling said second frame assembly to receive said third frame assembly at least partially within said second frame assembly when said second frame assembly is hingedly moved from said first open position to said second closed position while said third frame assembly is in said second folded position and is received at least partially within said first frame assembly; and at least one fourth wire frame support assembly defining a fourth predetermined portion of said figure, said fourth frame assembly hingedly connected to said first frame assembly for movement between a first erected position and a second folded position.

2. A framework and display as in claim 1 including a plurality of said fourth wire frame support assemblies, and wherein said fourth frame assemblies in said folded positions are located in side-by-side relationship with respect to each other.

3. A framework and display as in claim 2 further including means in operative relationship with said first and fourth frame assemblies for releasably locking said fourth frame assemblies in said erected positions for enabling said fourth frame assemblies to steadily support said framework and display.

4. A framework and display as in claim 3 wherein said figure is a deer.

5. A framework and display as in claim 4 wherein said first predetermined portion is a lower body portion of said deer.

6. A framework and display as in claim 5 wherein said second predetermined portion is an upper body portion of said deer.

7. A framework and display as in claim 6 wherein said third predetermined portion includes the head and neck portions of said deer.

8. A framework and display as in claim 7 wherein said fourth predetermined portions are leg portions of said deer.

9. A framework and display as in claim 8 further including:

a fifth wire frame assembly formed into a shape representative of deer antlers; and means in operative relationship with said third wire frame assembly for removably attaching said fifth wire frame assembly to said third wire frame assembly.

10. A framework and display as in claim 3 further including means in operative relationship with said first and second frame assemblies for holding said first and second frame assemblies together when said second frame assembly is in said second closed position.

11. A framework and display as in claim 10 wherein said locking means include openings defined by each of said fourth frame assemblies and retaining members hingedly connected to said first frame assembly, each of said retaining members removably positionable, respectively, within each of said openings for locking said fourth frame assemblies in said first erected positions, and said retaining members removable from within said openings for enabling said fourth frame assemblies to be hingedly moved to said second folded positions.

12. A framework and display as in claim 11 wherein each of said retaining members is substantially L-shaped.

13. A framework and display as in claim 10 further including means in operative relationship with said second and third frame assemblies for holding said second and third frame assemblies together when said third frame assembly is at least partially within said second frame assembly when said second frame assembly is hingedly moved from said first open position to said second closed position while said third frame assembly is in said second folded position and is received at least partially within said first frame assembly.

14. A framework and display as in claim 1 wherein each of said first, second, third and fourth wire frame assemblies defines a three-dimensional shape representative of a predetermined portion of a three-dimensional figure.

* * * * *